US006726079B2

(12) United States Patent
Münster

(10) Patent No.: US 6,726,079 B2
(45) Date of Patent: Apr. 27, 2004

(54) WIRE FEED DEVICE

(75) Inventor: Bruno Münster, Bad Ditzenbach (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/079,690

(22) Filed: Feb. 20, 2002

(65) Prior Publication Data

US 2002/0139159 A1 Oct. 3, 2002

(30) Foreign Application Priority Data

Feb. 21, 2001 (DE) ..... 101 08 332

(51) Int. Cl.[7] ..... B25C 3/00

(52) U.S. Cl. ..... 227/83; 227/81; 242/25 R; 242/566

(58) Field of Search ..... 227/80, 81, 82, 227/85, 87, 88, 89, 90; 242/25 A, 25 R, 566

(56) References Cited

U.S. PATENT DOCUMENTS 1,708,314 A * 4/1929 Leschhorn ..... 227/88
3,282,304 A * 11/1966 Coleman ..... 242/566
3,401,859 A * 9/1968 Rienks et al. ..... 242/615.3
3,417,492 A * 12/1968 Rutland et al. ..... 434/430
4,211,350 A * 7/1980 Kunka et al. ..... 227/8
4,410,123 A * 10/1983 Kunka et al. ..... 227/8
4,444,347 A 4/1984 Males
4,722,467 A * 2/1988 Kunka et al. ..... 227/82
5,692,700 A * 12/1997 Bobeczko ..... 242/588.2
5,788,139 A * 8/1998 Sikora ..... 227/82
5,836,539 A * 11/1998 Grimm et al. ..... 242/615.3

FOREIGN PATENT DOCUMENTS

DE 3120813 A1 3/1982
DE 19712862 C2 10/1998
DE 19752285 A1 5/1999

OTHER PUBLICATIONS

German Patent Office Search Report for DE 101 08 332.7.

* cited by examiner

*Primary Examiner*—Scott A. Smith
*Assistant Examiner*—Chukwurah Nathaniel
(74) *Attorney, Agent, or Firm*—Kevin L. Leffel

(57) ABSTRACT

The present invention provides a wire feed device for guiding and straightening a wire which is comprised of a wire infeed unit and a self-cleaning deflection head which are connected together by a flexible guide hose. The wire infeed unit has a guide passage therethrough whose inlet and outlet are offset so the wire will remain in contact with a contact element within the passage to generate a signal when the wire is in the passage. The deflection head has a guide arc-shaped guide passage therethrough which, in turn, have outwardly radiating pockets spaced along the outer side thereof which remove debris (e.g. the material abraded from the wire and wire shavings) transport it out of the deflection head. Dimpled guide points are formed on the other side of the arc-shaped guide passage opposite the pockets to facilitate the self-cleaning of the wire. A wire straightening sleeve is positioned downstream of the deflection head, which can generate a control/monitoring signal is positioned downstream of the head.

24 Claims, 7 Drawing Sheets

WIRE FEED DEVICE

FIELD OF THE INVENTION

The present invention relates to a device for feeding a wire into a stitching head of a duplicating machine or the like and in one of its aspects relates to a device for guiding, detecting, and straightening a wire before the wire is fed into a stitching head of a duplicating machine or the like wherein the device includes a deflecting head that is essentially self cleaning.

BACKGROUND OF THE INVENTION

Wire feed devices are commonly used in certain equipment (e.g. duplicating, copier, and like machines) for guiding, detecting and straightening a stitching wire before the wire is supplied to a stitching device. The stitching device, in turn, forms the wire into staples or the like which, in turn, are then used to secure a stack of sheets (e.g. copies) together at the exit of the copier. For example, German patent application DE 197 52 285 A1 describes a stitching device of this type which form staples from wire is stored in a cartridge that is fastened to the stitching device.

Another such wire feed device is disclosed in German patent application DE 197 12 862 wherein the leading end of the wire is fed from a stitching wire supply spool into a sheet stack stitching device through a guide tube. The wire supply spool is mounted on a movable bracket, which allows the supply spool to be moved between inside the device and the outside thereof. The stitching wire is transported through a guide tube to a wire-cutting device, a staple-forming device, and a staple-driving device, all of a conventional type. A first wire sensor extends into the transport path of the stitching wire and signals the user when the leading end of the wire passes by. This signal indicates that the manually driven threading procedure has ended and the stitching wire is ready for further motor-driven transport. The stitching wire is then further advanced until the leading edge of the stitching wire triggers a second wire sensor in the transport path which, in turn, stops the advance of the wire when the leading end of the wire reaches its delivery position within the stitching device. In this device, the wire sensors are actuated when the wire, itself, completes a respective electrical circuit.

The unexamined, laid-open German patent application DE 31 20 813 A1 discloses the use of wire sensors, such as those mentioned above, for sensing the wire transport, in a nonstop wire feed device for stitching equipment. In this device, a separate wire, from its own supply spool, is transported to an individually designed wire supply nozzle. A particular stitching wire is drawn from its spool by means of guide and transport rollers and is transported to its supply nozzle with the use of swiveled guide rollers that are insulated from ground. The wire, as it is being advanced, closes an electrical circuit, which, in turn, controls the advance of the wire through its assigned wire supply nozzle. Sensors in the wire transport nozzles close another respective electrical circuit upon contact with the wire, which, in turn, causes an indicator lamp to light up and thus indicate which wire supply nozzle is currently supplying wire.

Prior wire feed devices of the type have experienced problems due to abrasion of the wire, which occurs as the wire is guided and straightened within the feed device. As the wire abrades under prolong use, unwanted residues (i.e. metal shavings or bits of wire) can build-up and accumulate inside of the stitching device. Since this accumulated residue can conduct electricity, it can short the electric circuit of a wire sensor and thus produce a false signal.

This abrasion is caused, in part, because the wire contacts feed inlet and guide bushings in the prior wire feed devices that are typically made of a hardened material, e.g. steel. Further, abrasion may result when the cross-sections (e.g. circular) of the transport passages in these feed devices do not correspond to the rectangular profile of the stitching wire thus allowing some play in the wire as it moves therethrough. The latter problem has been recognized, see U.S. Pat. No. 4,444,347 wherein the use of a rectangular wire feed guide in the straightening sleeve of a wire feed device is suggested. When the wire is also rectangular, abrasion and the resulting residue in the stitching device is reduced.

However, even when a rectangular wire is guided and straightened through a rectangular wire guide, there is a likelihood that some abrasion will occur. Over a period of time, the abraded material (e.g. shavings, wire bits, etc.) can accumulate within the wire feed device which which, in turn, will adversely affect the performance of the device. Accordingly, it will be necessary to regularly clean the wire feed to remove this residue. Since the wire supply is generally positioned within highly sophisticated equipment, the wire supply is typically not readily accessible thereby making the maintenance thereof difficult and cost-intensive.

Accordingly, it can be seen that any device that can feed a stitching wire reliably to a wire utilization device (i.e. a stitching head for producing stitching wire bindings (staples) in a duplicating machine) and that, at the same time, has a low sensitivity to any material abraded from the wire, is highly desirable.

SUMMARY OF THE INVENTION

According to one aspect of the present invention, a wire feed device is provided for guiding and straightening a continuous strand of wire from a source to a utilization means (e.g. stitching mechanism) within a duplicating machine or the like. According to one embodiment, the wire feed device is comprised of a wire infeed unit and a deflection head which are connected together by a flexible guide hose which provides a continuous guide path for the wire through the wire feed device.

According to one further aspect of the invention, the wire infeed unit is comprised of a housing having an opening therethrough, which is adapted to guide the wire therethrough. An inlet nozzle, preferably made of an electrical nonconductive material (e.g. ceramic) and having a first guide passage therethrough, is releasably connected to the housing at the inlet end of the opening and a feed bushing having a second guide passage therethrough is mounted at the outlet end of the opening. The entries into both the first and second guide passages are tapered and the cross-sections of the passages are preferable rectangular (e.g. square) to alleviate abrasion of the wire as it passes through the wire infeed unit.

A contact element (e.g. a hollow cylinder) may be spring mounted in the opening between the inlet nozzle and the feed bushing and is adapted to remain in continuous contact with the wire as the wire passes therethrough. The center axis of the first guide passage in the inlet nozzle and the center axis of the second passage in the feed bushing are offset from each other to aid in maintaining the wire in contact with the contact element as the wire is advanced therethrough. An electrical conductor extends from the contact element to outside the housing where it is adapted to be connected to an electrical circuit which, in turn, will be closed to generate a signal when the wire is in contact with the contact element.

The deflection head according to one further aspect of the invention is comprised of a housing, which is preferably made in at least two parts, (e.g. a base plate and a cover plate) due to the sophisticated geometry of the housing. Further, for the ease in manufacturing, micronized powder injection molding methods can be used advantageously, wherein both metal (metal injection molding, MIM) and ceramics (ceramic injection molding, CIM) can be processed. The process technology is based on sintering an injection-molded part (green compact) to a solid body that is largely free of pores. In order to process the powder using injection molding technology, it is mixed with an organic binding agent to attain a thermoplastic molding compound. The binding agent must be removed again before sintering, which is usually carried out by smelting or catalytic degradation (see R. Rupprecht: "Mold release methods for microstructured components of plastic and metal," $4^{th}$ Status Colloquium PMT: Karlsruhe Research Center (2000)). Preferably, the deflection head is produced of metal using micronized powder injection molding or a comparable method wherein the deflection head will consist of two metal or ceramic parts that interlock with each other.

The housing of the deflection head may have a guide passage therethrough that is essentially arc-shaped whereby the wire is gradually deflected 90° as it passes through the deflection head. Outwardly radiating pockets are provided on at least on one side of the guide passage. Because of these pockets, debris (e.g. the material abraded from the wire and wire shavings) are removed from the wire and are transported out of the inside of the wire feed device due to the feeding of the wire and/or vibrations. This results in a self-cleaning of the wire feed device. The apparatus may be oriented such that gravity assists in drawing the debris through the pockets and out of the feed-head.

Preferably, dimpled guide points are formed on the other side of the arc-shaped guide passage wherein the grooves between the dimpled guide points are effectively aligned with respective pockets. This facilitates the self-cleaning of the wire guiding device.

A wire straightening sleeve may be positioned downstream of the deflection head and is adapted to receive the wire as it exits the head. Straightening sleeve may have a sheath of an electrically insulating material, e.g. plastic, thereon. The wire straightening sleeve may have an electrical connector which extends through the sheathe to provide a connection to a control and/or monitoring circuit which is closed when the wire contacts the sleeve.

The present invention can be used in all stitching devices in which printed or unprinted print media are conjoined with one another. In addition, use is possible in all devices in which a wire in general is guided, detected and/or straightened and in which wire abrasion possibly poses a problem.

BRIEF DESCRIPTION OF THE DRAWINGS

The actual construction, operation, and the apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents, which may be included within the spirit and scope of the invention, as defined by the appended claims.

DESCRIPTION OF THE PREFERRED EMBODIMENTS

Figure 1:
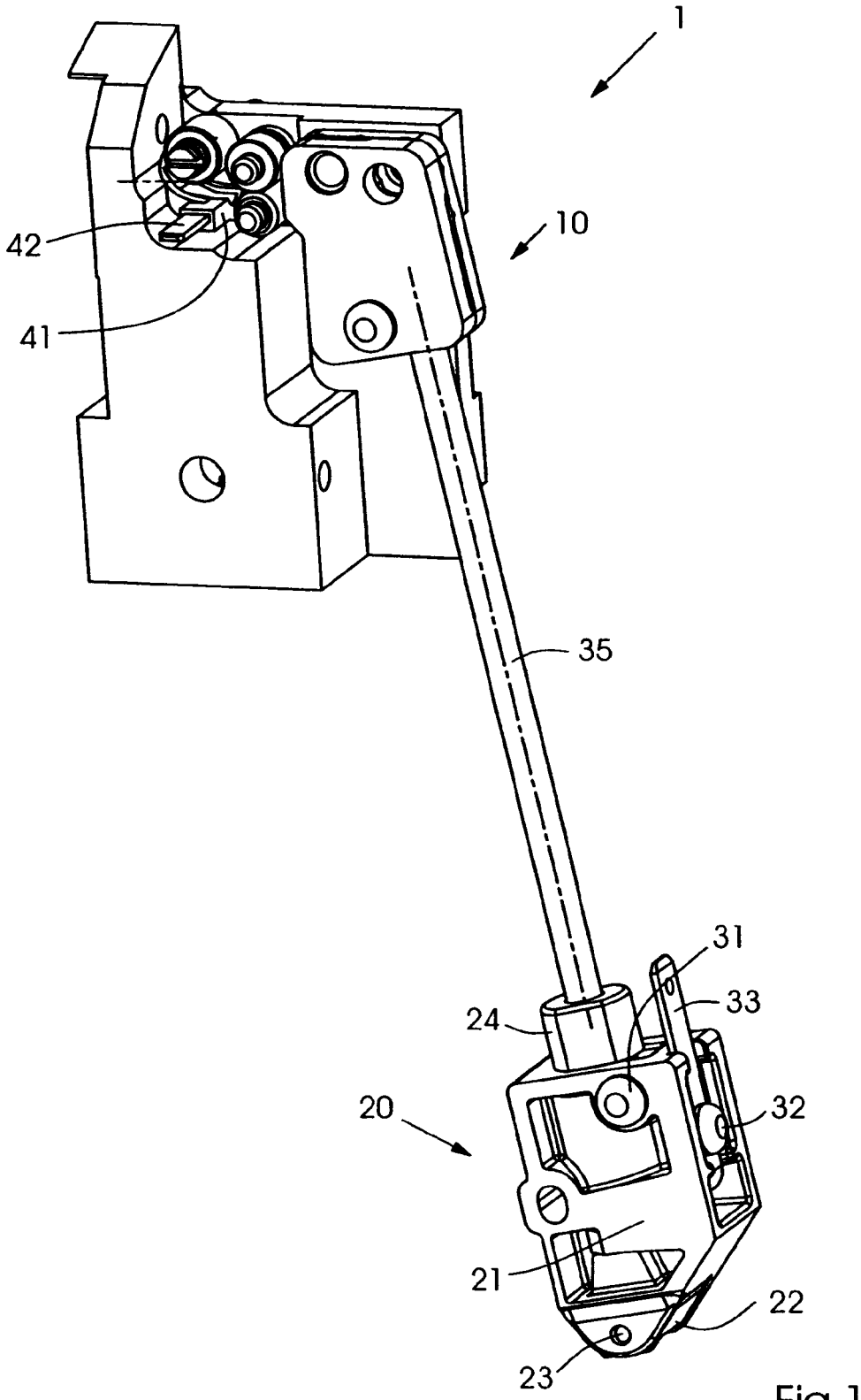
FIG. 1 shows a perspective view of the wire feed device for straightening and guiding wire in accordance with the present invention.

Referring now to the drawings, FIG. 1 is a perspective view of the overall structure of a wire feed device 1 in accordance with the present invention which is to be used in forming staples or other wire fasteners in certain equipment (e.g. a copying or duplicating machine) (not shown). For the sake of simplifying the following description, only the components relevant to the wire feed device 1 will be referred to and discussed below. Other, generally known drive and/or guide means, as well as any electric/electronic circuits, necessary for the ultimate operation of the device are not shown or/and will described only in a general way when necessary for a better understanding of the present invention.

Basically, wire feed device 1 is comprised of a wire deflection head 10 and a wire infeed unit 20 which are joined together by a flexible guide 34 (FIG. 3) which, in turn, is mounted within flexible hose 35. When the feed device 1 is in an operable position within its designated equipment (e.g. copier), a wire is fed from a source (not shown) into the infeed unit 20, through guide 34 within hose 35, and is deflected out of deflection head 10 on to a utilization device (e.g. stitching device, a staple former, etc., none shown).

Wire infeed unit 20 is comprised of a housing 21 having a wire inlet nozzle 22 mounted at one end thereof. Inlet nozzle 22 is form-fitted within housing 21 and has a catch 23 (e.g. a biased detent) thereon which releasably latches the wire inlet nozzle 22 in its operable position within the housing 21 Housing 21 is advantageously made of electrically insulating plastic, preferably by injection molding.

Figure 2:
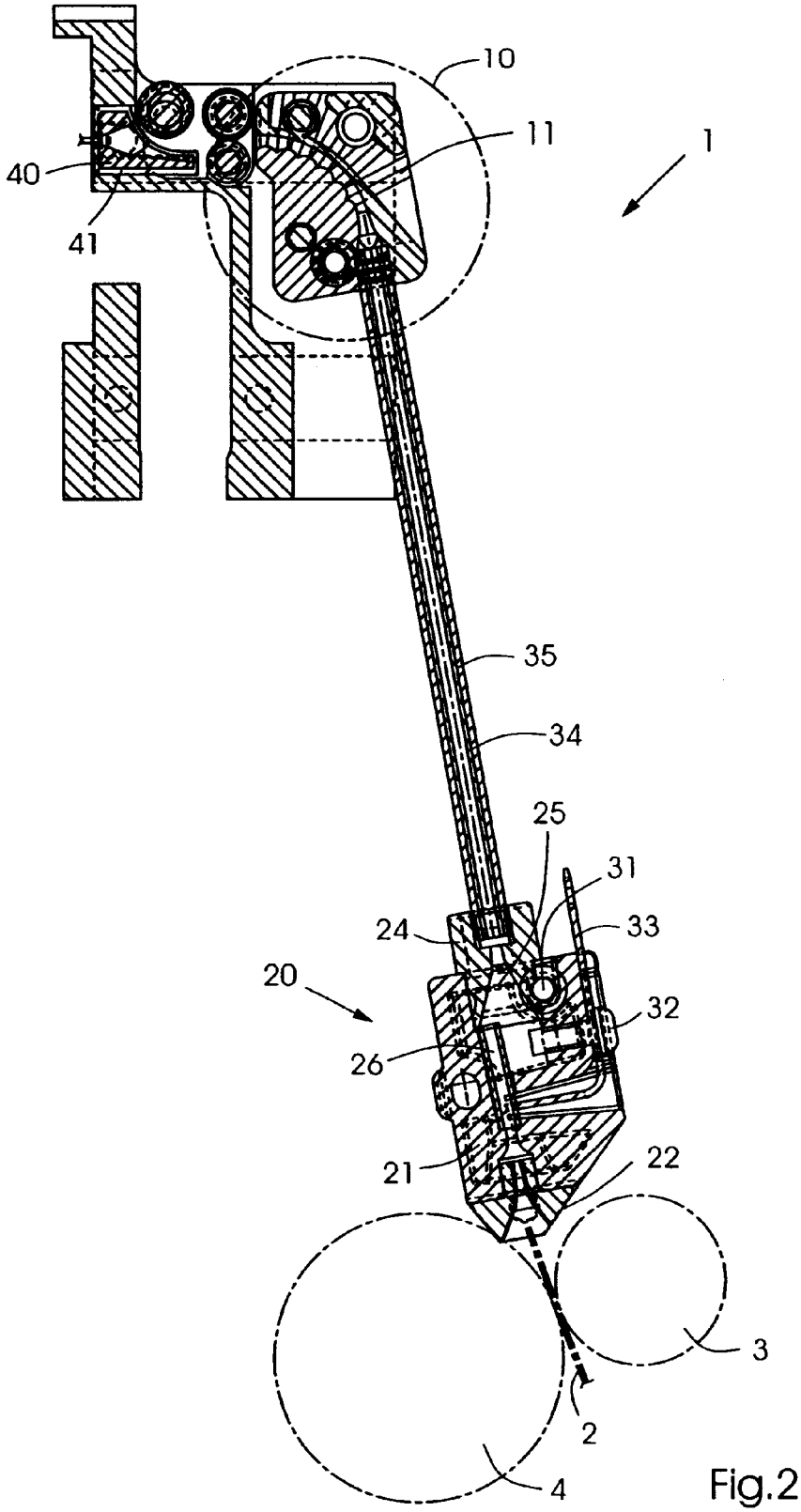
FIG. 2 is cross-sectional view of the wire feed device of FIG. 1.
Figure 3:
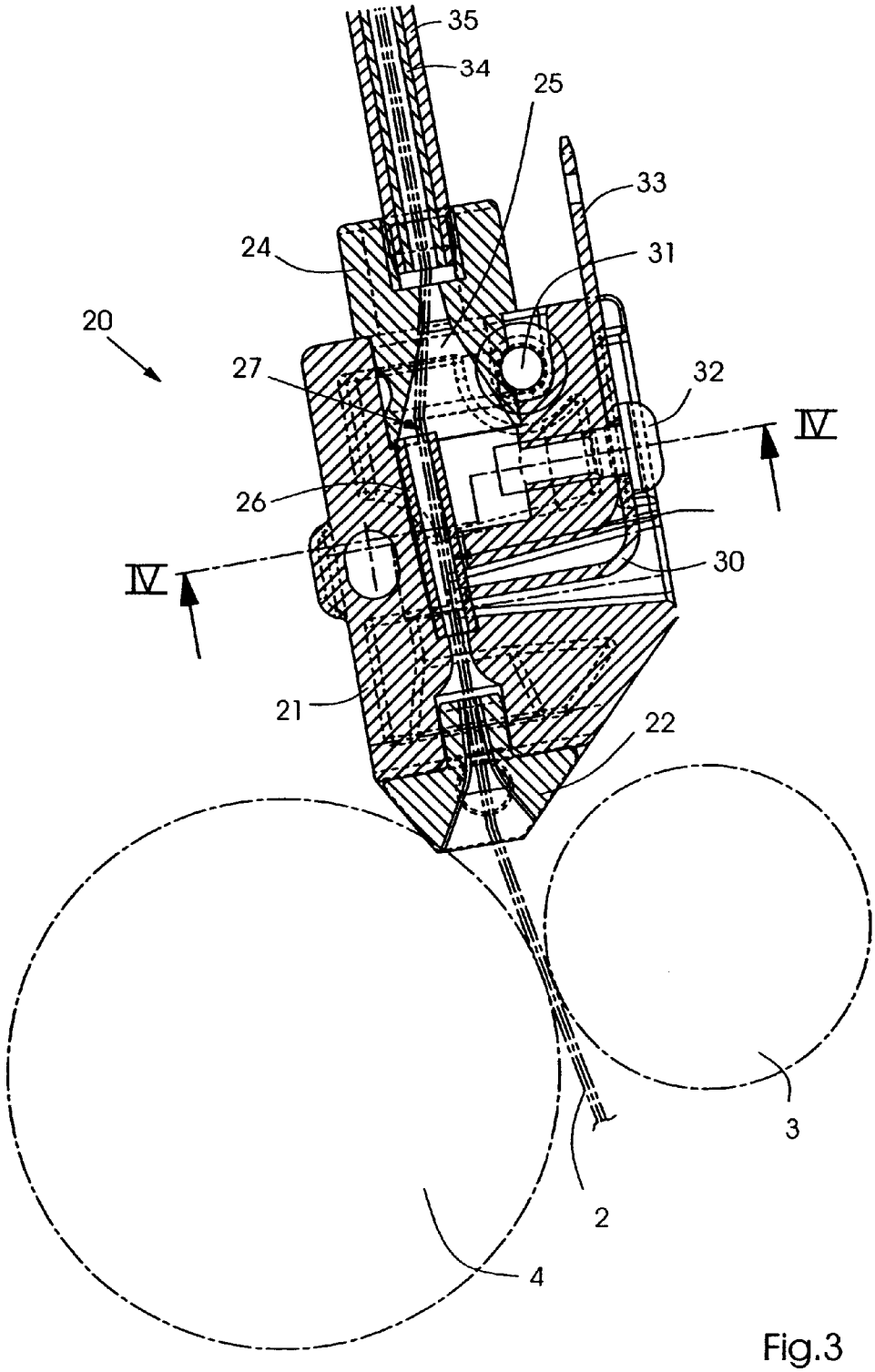
FIG. 3 is an enlarged, cross-sectional of the wire infeed unit of the wire feed device of FIG. 1.

FIG. 2 shows the basic path or guide opening through which wire feed device 1 the wire 2 is guided. Wire 2 is slid into the wire inlet 22 by hand or by means of transport rollers 3, 4. Wire inlet 22 is advantageously manufactured of ceramic with a hardness greater than 1400 HV 10, in particular using powder injection molding. As best seen in FIG. 3, feed inlet 22 has a tapered or pyramid-shaped entry in order to decrease the abrasion of a wire 2 having rectangular (e.g. square) cross-section. Wire 2 passes through the tapered entry of wire inlet nozzle 22 and enters a contact element, i.e. hollow cylinder 26, which is positioned the inside of housing 21 and which is aligned with the entry opening of wire inlet nozzle 22. Contact element cylinder 26 is spring mounted so that it is pressed against the wire 2 and is in continuous contact therewith as the wire passes through element 26. Wire 2 passes through contact cylinder 26 and into a feed bushing 24, which is mounted at the other end of housing 21. Bushing 24 has a tapered or cone-shaped mouth or entry opening to allow easy entry of the wire. The feed bushing 24 is manufactured of an electrically non-conductive material.

Figure 4:
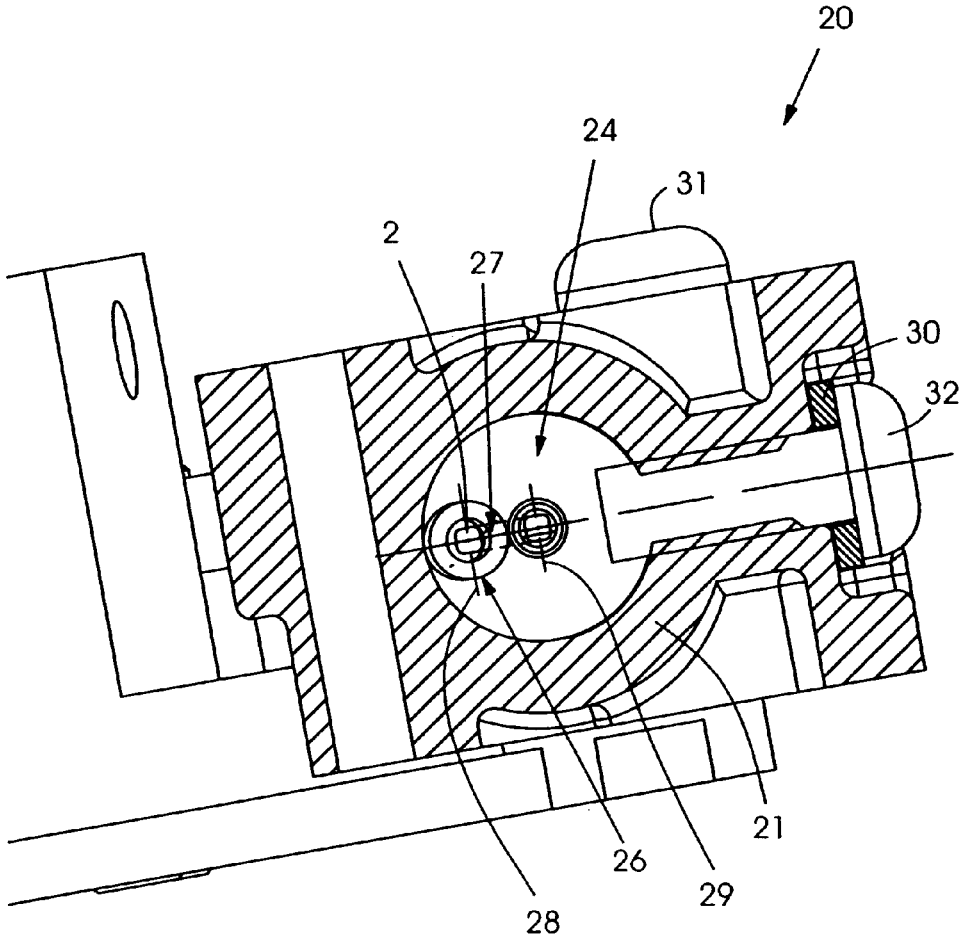
FIG. 4 is a cross-sectional view of the wire infeed unit of the device taken along line IV—IV of FIG. 3.

Wire inlet 22 and feed bushing 24 are positioned in housing 21 in such a way that the center axis 28 of wire inlet 22 (FIG. 4), and thus also the axis of hollow cylinder 26, is aligned with the edge of the mouth of feed bushing 24, i.e. the center axis 28 of the guide passage through wire inlet nozzle 22 and the center axis 29 of guide passage through the feed bushing 24 are offset from one another. When wire 2 comes in contact with the cone-shaped mouth of feed bushing 24, the wire is deflected during further feed, due to the shape of the taper of the feed bushing mouth, and is guided into feed bushing 24. During the deflection of the wire 2 inside the mouth of feed bushing 24, wire 2 is kept in continuous contact with the contact area 27 along the inner wall of hollow cylinder 26 due to the offset between the axes of hollow cylinder 26 and feed bushing 24 and the bias of the spring-mounted cylinder 26.

Referring again to FIG. 3, an electric conductor 30 is connected to housing 21 by a screw 32 in such a way that the inner end of the electric conductor 30 is in electrical contact with the outer wall of hollow cylinder 26. The outer end of the electric conductor 30 is formed to shape a flat connector 33, by means of which the electric conductor 30 can be connected to an electronics module (not shown). As will be understood by persons skilled in the art, the electronics module may be any which is designed so that a circuit is closed when wire 2 is in contact with the contact area 27 in hollow cylinder 26 and which will then generate a signal in response thereto. On one hand, the signal can be used to indicate to the user that the wire is located inside the housing and/or the signal can also be used to trigger an automatic feed or it can be used in other ways.

Figure 5:
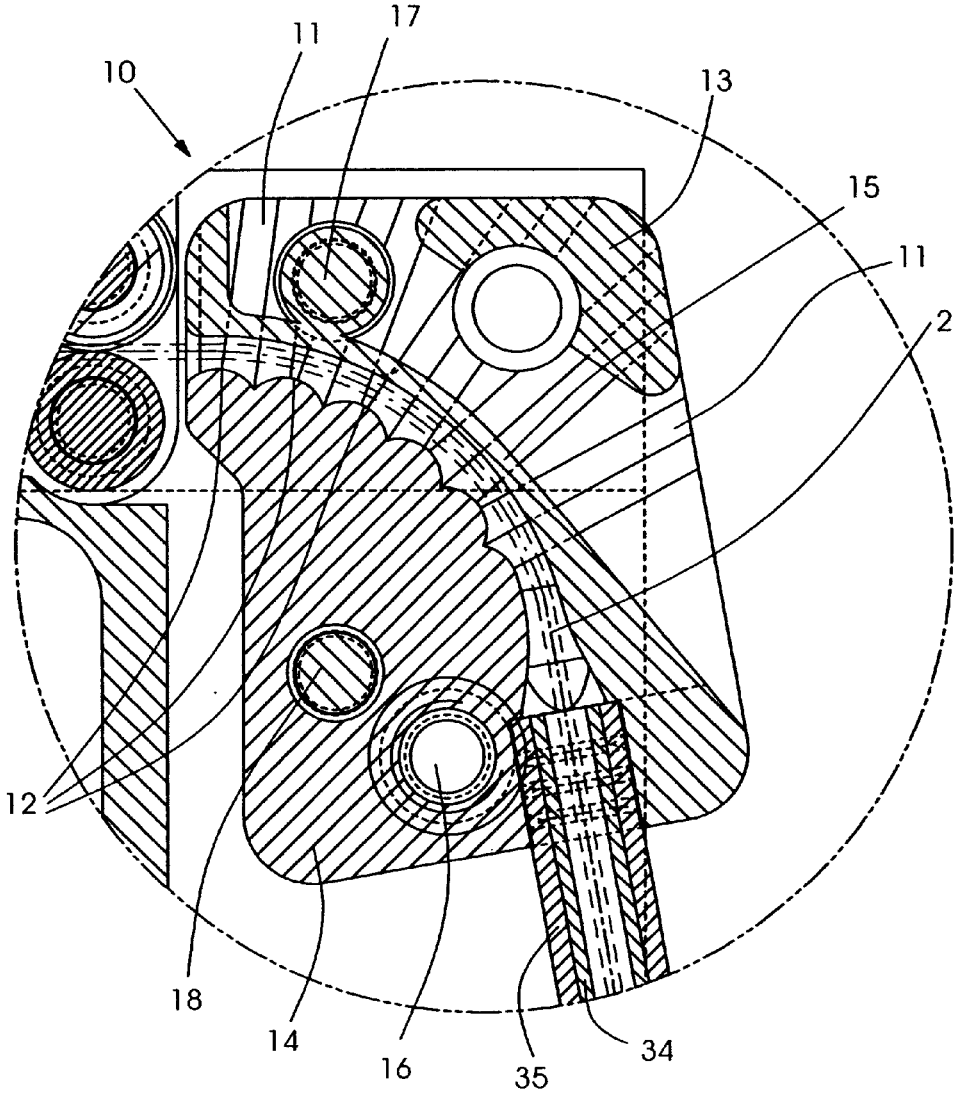
FIG. 5 is an enlarged, cross-sectional of the deflection head of the wire feed device of FIG. 1.
Figure 6:
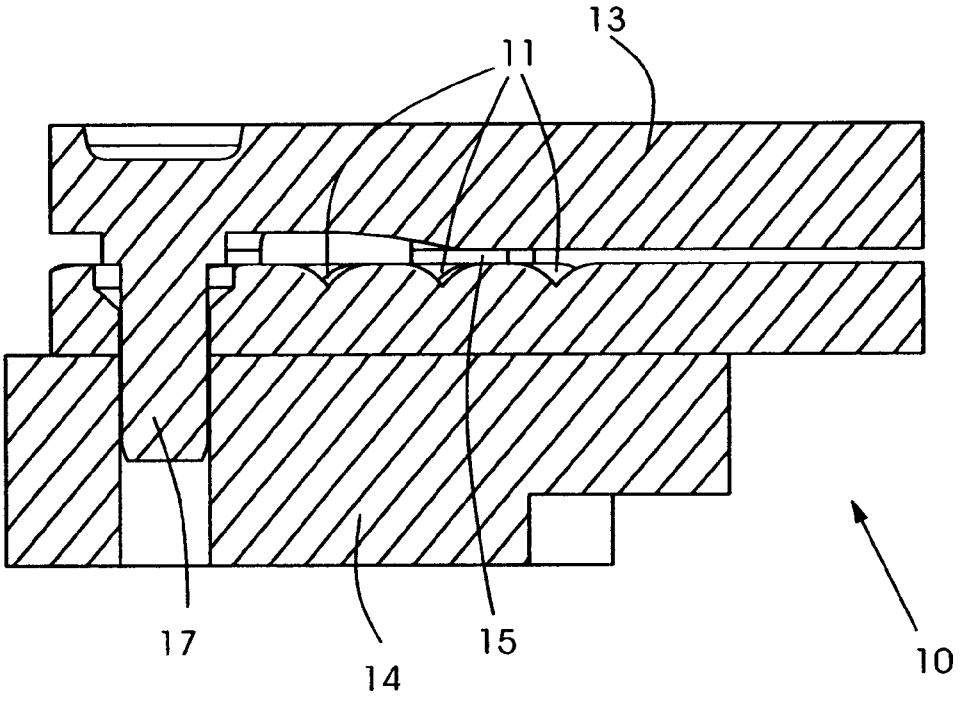
FIG. 6 is a cross-sectional of the deflection head of FIG. 5.

The flexible wire guide 34 that is sheathed within the flexible stabilizing hose 35 and is connected or fitted at one end into feed bushing 24, e.g. by means of a pressure fit connection. Wire guide 34 and stabilizing hose 35 are connected at their other end into deflection head 10 as shown in FIGS. 2 and 5. As can be seen in FIGS. 5 and 6, the deflection head 10 is comprised of two parts, a base plate 14 and a cover plate 13. Both the base plate 14 and the cover plate 13 are advantageously manufactured using powder injection molding. Preferred materials for manufacturing of base plate 14 and cover plate 13 include metals or ceramics of adequate hardness. Cover plate 13 aligned and fitted into the base plate 14 with two pins 17 for easier assembly and increased stability and is fastened thereto by means of a screw 16 or the like.

A web guide is provided on cover plate 13 which forms a substantially circular or arc-shaped guide passage 15 for wire 2 through deflection head 10 when the cover plate and the base plate are assembled. Base plate 14 has a plurality (five shown) of pockets or grooves 11 formed therein which are spaced along guide passage 15. The pockets 11 may radiate outward from a common geometric origin. Each of pockets 11 have one end (i.e. inner end) which opens into the guide passage 15 when head 10 is assembled and the other end (i.e. outer end) which opens to a area outside of the deflection head 10. That is, the pockets 11 form passages between the guide passage 15 and an area or outside of the deflection head 10.

Debris (i.e. dirt particles, material abraded from the wire, wire shavings, etc.), that usually stick to the wire and which otherwise might accumulate inside the wire feed device 1, will be scraped off into the pockets 11 as the wire 2 advances through the web guide 15. The movement of the wire 2, itself, and/or the vibrations from the inside of the wire feed device 1 will aid in moving the scraped debris through the pockets 11 and out of feed-head 10 into the surrounding area or into a suitable catch basin (not shown). The apparatus may be oriented such that gravity assists in drawing the debris through the pockets 11 and out of the feed-head 10.

This cleaning property of the pockets 11 is enhanced by providing dimpled guide points 12 along the inner curved surface of the circular or arc-shaped guide passage 15. Preferably, the grooves between the dimpled guide points 12 on the inner side of the passage are essentially aligned with and are opposite to the pockets 11 on the outer curved surface of the guide passage. It should be understood, that while five dimpled guide points 12 and five corresponding pockets 11 are shown, other numbers of dimpled guide points and pockets can be used without departing from the present invention.

Figure 7:
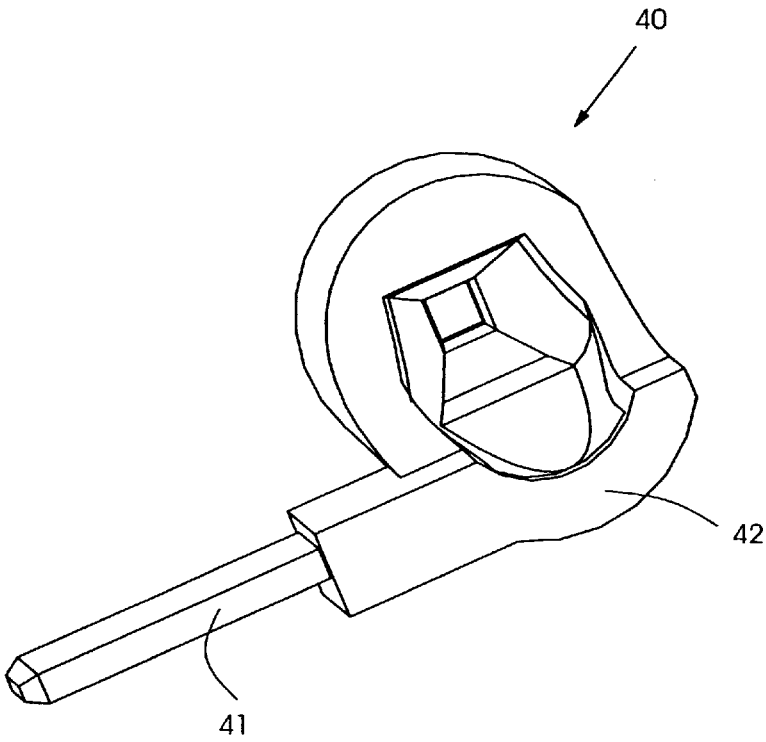
FIG. 7 is an isolated, perspective view of the straightening sleeve of the present invention when removed from the wire feed device of FIG. 1.

Wire 2 is deflected approximately 90° and exits the deflection head 10 in the direction of a stitching device or the like (not shown) and passes through a straightening sleeve 40 (FIGS. 1 and 7). The passage for guiding wire 2 through straightening sleeve 40 is preferably rectangular in cross-section to help minimize wire abrasion at this location. The straightening sleeve 40 is comprised of an electrically conductive material (preferably using powder injection molding techniques) which, in turn, is subsequently essentially sheathed with an electrically non-conductive material 42 which is carried out by another injection molding process. Sheathe 42 prevents any unintentional electrical contact between the straightening sleeve 40 and the surrounding housing with the only electrically conductive exposure of sleeve 40 being through a connector-like pin 4 on sleeve 40 that extends laterally out through sheath 42.

Pin 4 is adapted to be connected to a conventional electronics module (not shown) so that wire 2 contacts the inner surface of straightening sleeve 40, a second electric circuit will be closed. In this way, a second signal will be generated by the module as soon as wire 2 comes in contact with straightening sleeve 40. This signal can be used to monitor and/or control the wire advance, i.e. switch off the wire advance when the wire comes in contact with straightening sleeve 40 if the wire utilization device (e.g. a stitching device) is not ready to receive the wire.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. A deflection head for guiding wire in a wire feed device; said deflection head comprising:

a housing, a guide passage through said housing for guiding a wire through said housing; and at least one pocket positioned along said guide passage for cleaning debris from said wire as said wire passes through said cleaning passage;

wherein said guide passage has a curved contour through said housing and said pocket is positioned along said curved contour.

2. The deflection head of claim 1 wherein said pocket is formed by a groove in said housing which opens at one end into said guide passage and which opens at its other end to the outside of said housing.

3. The deflection head of claim 1 wherein said at least one pocket is comprised of a plurality of pockets spaced along said curved contour.

4. The deflection head of claim 1 wherein said housing is comprised of metal and is produced using a micronized powder injection process.

5. The deflection head of claim 1 wherein said housing is comprised of ceramic.

6. The deflection head of claim 1 wherein said housing comprises:

a base plate;

a cover plate; and means for securing said base plate and said cover plate together.

7. The deflection head of claim 1 wherein the cross-section of said guide passage is substantially rectangular.

8. The deflection head of claim 1, wherein said wire is deflected substantially 90° as it passes through said passage.

9. A deflection head for guiding and straightening wire in a wire feed device; said deflection head comprising:

a housing, a guide passage through said housing for guiding a wire through said housing; and at least one pocket positioned along said guide passage for cleaning debris from said wire as said wire passes through said cleaning passage;

wherein said pocket is formed by a groove in said housing which opens at one end into said guide passage and which opens at its other end to the outside of said housing;

wherein said at least one pocket is comprised of a plurality of pockets spaced along said guide passage; each of said plurality of said pockets formed by a groove in said housing which opens at one end into said guide passage and which opens at its other end to the outside of said housing;

wherein said guide passage has a curved contour through said housing whereby said wire is deflected substantially 90° as it passes through said passage;

wherein said plurality of said pockets radiate outwardly from a common geometric point; and dimple guide points spaced along the inner side of said curved guide passage; said dimple guide points having grooves therebetween.

10. The deflection head of claim 6 wherein a respective groove between said dimple guide points is positioned on said inner side of said curved guide passage substantially aligned with and opposite to a respective pocket on said outer side of said guide passage.

11. A wire infeed unit for a wire feed device comprising:

a housing having an opening therethrough for guiding a wire through said housing, said opening having a first end and a second end; and a wire inlet, having a first guide passage therethrough, secured at said first end of said opening; said first guide passage having a pyramid-shaped entry.

12. The wire infeed unit of claim 11 wherein said wire inlet is releasably secured in said housing.

13. The wire infeed unit of claim 11 wherein said housing is comprised of an electrically-nonconductive material.

14. The wire infeed unit of claim 13 wherein said electrically-nonconductive material is ceramic.

15. The wire infeed unit of claim 11 including:

a contact element positioned in said opening between said first end and said second end whereby said wire will be in continuous contact with therewith as said wire passes therethrough; and a sensor in electrical contact with said contact element for generating a signal when said wire contacts said contact element.

16. The wire infeed unit of claim 15 wherein said contact element comprises:

a hollow cylinder, which is spring, mounted in said opening through said housing whereby it is biased against said wire as said wire passes therethrough.

17. The wire infeed unit of claim 16 wherein the center axis of said guide passage in said feed inlet and the center axis of said guide passage are offset from each other.

18. A wire feed device for guiding a wire comprising:

(a) wire infeed unit for a wire feed device comprising:

a housing having an opening therethrough for guiding a wire through said housing and having a pyramid-shaped entry;

(b) a deflection head, comprising:

a guide passage through said deflection head for guiding a wire through said deflection head; and at least one pocket positioned along said guide passage for cleaning debris from said wire as said wire passes through said cleaning passage; and (c) a flexible guide connecting said opening through feed inlet unit to said guide passage through said deflection head to thereby provide a continuous guide path for said wire through said wire feed device; and (d) a straightening sleeve positioned downstream of said deflection head and having a guide passage therethrough adapted to receive said wire from said deflection head having a rectangular cross-section pyramidal inlet.

19. A wire feed device for guiding and straightening a wire comprising:

a wire infeed unit for a wire feed device comprising:

a housing having an opening therethrough for guiding a wire through said housing, said opening having a first end and a second end;

a wire inlet, having a first guide passage therethrough, secured at said first end of said opening; said first guide passage having a pyramid-shaped entry; and a feed bushing, having a second guide passage therethrough, mounted at said second end of said opening, said second guide passage having a tapered entry;

a deflection head for guiding and straightening wire in a wire feed device; said deflection head comprising:

a housing, a third guide passage through said housing for guiding a wire through said housing; and at least one pocket positioned along said guide passage for cleaning debris from said wire as said wire passes through said cleaning passage; and a flexible guide connecting said opening through feed inlet unit to said third guide passage through said deflection head to thereby provide a continuous guide path for said wire through said wire feed device; and a straightening sleeve positioned downstream of said deflection head and having a fourth guide passage therethrough adapted to receive said wire from said deflection head; said fourth guide passage having a rectangular cross-section;

wherein said straightening sleeve includes:

a housing having an electrically-insulating sheath thereon;

an electrically conductive connection element attached to said housing and extending through said sheath, said connection element being adapted to be connected to an electrical circuit.

20. An apparatus for guiding a rectangular stitching wire, comprising:

a deflection head;

a wire guide passage through said deflection head for guiding the rectangular stitching wire through the deflection head; and, at least one pocket positioned along said guide passage that allows debris from the rectangular stitching wire to exit the guide passage.

21. A method for guiding a rectangular stitching wire, comprising:

feeding rectangular stitching wire through a guide passage in a deflection head having at least one pocket positioned along said guide passage that allows debris to exit said guide passage.

22. The method of claim 21 wherein said pocket is formed by a groove in said housing which opens at one end into said guide passage and which opens at its other end to the outside of said housing.

23. The method of claim 21 wherein said guide passage has a curved, arc-shaped contour through said housing and said pocket is positioned along said arc-shaped contour and said at least one pocket is comprised of a plurality of pockets spaced along said arc-shaped contour.

24. The method of claim 21, comprising deflecting said wire substantially 90° as it passes through said passage.

* * * * *